US010538365B2

(12) United States Patent
Wood

(10) Patent No.: US 10,538,365 B2
(45) Date of Patent: Jan. 21, 2020

(54) INSULATING DEVICE AND LATCH

(71) Applicant: Cascade Mountain Technologies, LLC, Issaquah, WA (US)

(72) Inventor: Richard Wood, Snoqualmie, WA (US)

(73) Assignee: CASCADE MOUNTAIN TECHNOLOGIES, LLC, Issaquah, WA (US)

( * ) Notice: Subject to any disclaimer, the term of this patent is extended or adjusted under 35 U.S.C. 154(b) by 89 days.

(21) Appl. No.: 15/872,897

(22) Filed: Jan. 16, 2018

(65) Prior Publication Data

US 2019/0217999 A1 Jul. 18, 2019

(51) Int. Cl.

| | |
|---|---|
| ***B65D 43/22*** | (2006.01) |
| ***B65D 43/24*** | (2006.01) |
| ***E05C 3/16*** | (2006.01) |
| ***B65D 81/38*** | (2006.01) |
| ***E05B 65/52*** | (2006.01) |
| *B65D 43/16* | (2006.01) |

(52) U.S. Cl.

CPC ..... *B65D 43/22* (2013.01); *B65D 43/24* (2013.01); *B65D 81/3813* (2013.01); *E05B 65/5276* (2013.01); *E05C 3/16* (2013.01); *B65D 43/16* (2013.01)

(58) Field of Classification Search

CPC .... B65D 43/00–24; B65D 81/00–3813; B65D 43/16

See application file for complete search history.

(56) References Cited

U.S. PATENT DOCUMENTS

| | | | | |
|---|---|---|---|---|
| 3,782,765 | A | 1/1974 | Wallyn | |
| 5,193,706 | A * | 3/1993 | Hanna | B25H 3/02 220/315 |
| 5,577,779 | A | 11/1996 | Dangel | |
| 6,398,272 | B1 * | 6/2002 | Plummer | E05C 19/06 292/246 |
| 6,789,692 | B2 * | 9/2004 | Prezelin | B65D 45/20 190/119 |
| 7,540,364 | B2 | 6/2009 | Sanderson | |
| 7,918,357 | B2 * | 4/2011 | Jaeb | A45C 13/1084 206/307 |

(Continued)

OTHER PUBLICATIONS

"40 Quart XFP Roto Molded Cooler," Xtreme Fishing Products, 2016, URL=https://www.xtremefishingproducts.com/product-page/40-quart-xfp-roto-molded-cooler, download date Jan. 9, 2018, 2 pages.

(Continued)

*Primary Examiner* — Kareen K Thomas

(74) *Attorney, Agent, or Firm* — Cozen O'Connor

(57) ABSTRACT

The present disclosure generally relates to an insulating device, for example a cooler, and a latch and latching system for securing a lid of the insulating device in a closed position. More specifically, the insulating device includes a chest coupled to a lid, and a ledge extending from the chest. A slot is formed in the ledge and for each slot, a pair of protrusions extend from a bottom surface of the ledge on other side of the slot. The protrusions are received by corresponding recesses formed in the latch. Thus, when the latch is in the engaged position, the protrusions are physically securely engaged in the recesses by virtue of the latch being in a tensioned configuration.

20 Claims, 8 Drawing Sheets

(56) References Cited

U.S. PATENT DOCUMENTS

| | | | | |
|---|---|---|---|---|
| 8,910,819 | B2 * | 12/2014 | Seiders | B65D 81/3816 220/326 |
| 9,834,342 | B2 * | 12/2017 | Seiders | B65D 81/3816 |
| 10,151,520 | B2 * | 12/2018 | Christensen | F25D 3/06 |
| D836,994 | S * | 1/2019 | Meda | D7/605 |
| D836,995 | S * | 1/2019 | Carey | D7/605 |
| 2006/0032860 | A1 | 2/2006 | Hase | |
| 2009/0139245 | A1 * | 6/2009 | Blackway | F25B 21/02 62/3.62 |

OTHER PUBLICATIONS

"75-Quart Performance Ice Chest | Insulated Rotomolded Cooler (75 qt.)," Driftsun, 2017, URL=https://www.driftsun.com/products/75-quart-performance-ice-chest-insulated-rotomolded-cooler-75-qt, download date Jan. 9, 2018, 4 pages.

"Fatboy 45qt Roto Molded Cooler," Fatboy, URL=https://fatboycoolers.com/fatboy-45qt-roto-molded-cooler.html, download date Jan. 9, 2018, 4 pages.

"Grizzly 40 Cooler," Grizzly, URL=https://www.grizzlycoolers.com/coolers/grizzly-40, download date Jan. 9, 2018, 6 pages.

"Ozark Trail 52-Quart High-Performance Cooler, Grey," Walmart, URL=https://www.walmart.com/ip/Ozark-Trail-52-Quart-High-Performance-Cooler-Grey/49229404, download date Jan. 9, 2018, 8 pages.

Photographs showing design of prior art product sold in this country on May 30, 2008, 22 pages.

"Rotomolded Insulated Coolers Foam Beer Can Cooler for Outdoor Camping," Alibaba, URL=https://www.alibaba.com/product-detail/Rotomolded-Insulated-Coolers-Foam-Beer-Can_60593942949.html, download date Jan. 9, 2018, 5 pages.

"RTIC 20—White," RTIC, URL=https://www.rticcoolers.com/shop/coolers/roto-molded/RTIC-20-White, download date Jan. 9, 2018, 11 pages.

"Venture 45 Cooler," Otterbox, URL=https://www.otterbox.com/en-us/venture-45/cooler/otr56-cooler-45.html, download date Jan. 9, 2018, 6 pages.

* cited by examiner

INSULATING DEVICE AND LATCH

TECHNICAL FIELD

The present disclosure generally relates to an insulating device, for example a cooler, and a latch and latching system for securing a lid of the insulating device in a closed position.

BACKGROUND

Description of the Related Art

There are many commercially available insulating devices, each utilizing a variety of latches and latching systems. For example, a portable cooler or "ice chest" may often include a lid coupled to a base with a hollow interior compartment, the lid having a bottom surface with a ridge extending around a peripheral edge of the bottom surface that is received by an upper edge of the hollow interior compartment. The upper edge of the compartment has a size and a shape to engage the ridge in a friction fit when a user places the lid in the closed position. However, such latching mechanisms are often unsecure because a slight force can unsecure the ridge, thus allowing the lid to open.

Over time, repeated opening and closing cycles can also cause the material comprising the ridge of the lid and the edge of the base to deteriorate or deform, which further loosens the friction fit between the lid and the base, allowing the lid to become unsecured more easily. Such problems can be further exacerbated if the cooler is used in rugged, tough conditions, as is commonly the case with insulating devices. However, if the lid and the base are dimensioned to produce a tighter friction fit to counterbalance these disadvantages, then the lid becomes very difficult to open for the user, as a vacuum is created between the hollow interior compartment of the base and the lid.

Past attempts to solve this problem have utilized a separate latch coupled to the lid and a latch receiving mechanism coupled to the base. In some examples, the latch and the latch receiving mechanism are formed of metal and are coupled to the lid and the base, respectively, with metal screws or glue. However, this may only prolong the amount of time before issues arise as described above. Again, repeat cycles of use cause the metal components to deteriorate, as the latch and latching mechanism are under constant tension when in the engaged position, thus producing stress and strain on the metal components, until they yield in a shear failure. Such a failure not only renders the cooler useless and forces the user to buy replacement parts, but until the parts are replaced, the metal components that have failed in shear may have sharp edges that also cause the cooler to be unsafe for personal use.

As such, there remains a need for an insulating device and latch that allow for prolonged use without failure while securely holding the lid in the closed position in a variety of use environments.

BRIEF SUMMARY

The present disclosure is generally directed to an insulating container system, such as a cooler, including a chest, the chest having a bottom with a periphery and at least one peripheral wall that extends from the bottom along the periphery to delineate an interior of the chest. The chest further includes an opening at a top thereof with the top opposed across a height of the chest from the bottom of the chest. The chest has a front with a ledge that extends outwardly from the at least one peripheral wall at the front wherein the ledge includes at least one slot that extends laterally through the ledge and, for each of the at least one slot, a pair of protrusions, with one of the pair of protrusions on each side of the respective slot.

A lid is coupled to the chest for movement between a closed position and an open position. In the closed position the lid covers the opening of the chest to seal the interior of the chest from an exterior thereof. In the open position, at least a portion of the lid is spaced from the opening to provide access to the interior of the chest from the exterior. To assist in securing the lid to the chest, at least one latch is coupled to the lid in a cavity formed in the lid and aligned with the slot of the ledge when the lid is in the closed position.

The latch has a handle and a pair of recesses formed therein. The latch is also elastically stretchable from a relaxed configuration to a tensioned configuration and movable between an engaged position where the latch is in the tensioned configuration and a disengaged position in which the latch is in the relaxed configuration. In the engaged position and the tensioned configuration, the latch securely couples, under tension, a front portion of the lid in the closed position to the chest. In the disengaged position, the front portion of the lid is released from the chest to allow the lid to move to the open position. The recesses are sized to physically securely engage complimentary ones of the protrusions when the latch is in the engaged position and under tension from elastic deformation when in the tensioned configuration.

In an embodiment, when the lid is in the closed position, a seal forms between the interior of the chest and the exterior thereof and in some cases, the seal is a hermetic seal. In other embodiments, the slot is sized to engage a portion of the latch in the engaged position in a friction fit to further physically secure the lid to the chest. In yet further embodiments, a carrying handle is coupled to the peripheral wall in order to easily facilitate carrying of the insulating device by a user and an external cavity is formed adjacent the ledge with a bottle opener coupled to the chest and overlying a portion of the external cavity.

The insulating system further includes a slot wherein each surface defining the slot is flat and planar. To further assist a user with manipulating the latch, the handle of the latch can includes a pair of opposing curved inserts each defined by a ridge wherein the pair of opposing curved inserts are sized to receive one or more fingers of a user.

In an alternative embodiment, the insulating device is provided with a latch having a pair of protrusions that securely couple the front portion of the lid in the closed position to the chest by being physically securely engaged to complimentary recesses formed in the ledge extending from the chest. In certain instances, the at least one peripheral wall is a shell with an exterior wall and an interior wall, wherein the exterior wall is spaced from the interior wall and the space is filled with insulation. In yet other embodiments, the bottom of the chest and the at least one peripheral wall are integrally formed as unitary member.

In a further alternative embodiment, the latch includes a cylindrical base having a central hole therethrough and a body coupled to the base and having a first portion adjacent the base and a second portion. In some instances, the body includes a thickness that is continuously tapered along its length, or in other words, a thickness of the first portion is greater than a thickness of the second portion. A receiving member is coupled to the body adjacent the second portion with the receiving member having a first surface opposite a second surface and further including one or more recesses formed in the first surface and spaced from the body. A handle is coupled to the second surface and extends from the second surface. The latch is comprised of an elastically stretchable material and is stretchable between a relaxed position and a tensioned position, in the tensioned position the latch being under tension from elastic deformation. The first surface of the latch is flat and planar and the second surface is a curved surface, or a non-linear surface. The latch can further includes a pair of opposing curved inserts, as above, with each insert defined by a ridge extending toward the second surface.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with insulating devices and latches have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

The headings and Abstract of the Disclosure provided herein are for convenience only and do not interpret the scope or meaning of the embodiments.

This disclosure describes various apparatus, methods, systems, and articles related to providing an insulating device with a latch to securely engage a lid of the insulating device in a closed position while reducing the possibility of failure. While described in terms of an exemplary insulating device, such as a cooler, such disclosure may be used in conjunction with other insulating devices or containers, or other devices, that generally would benefit from the latching system described herein.

Figure 1A:
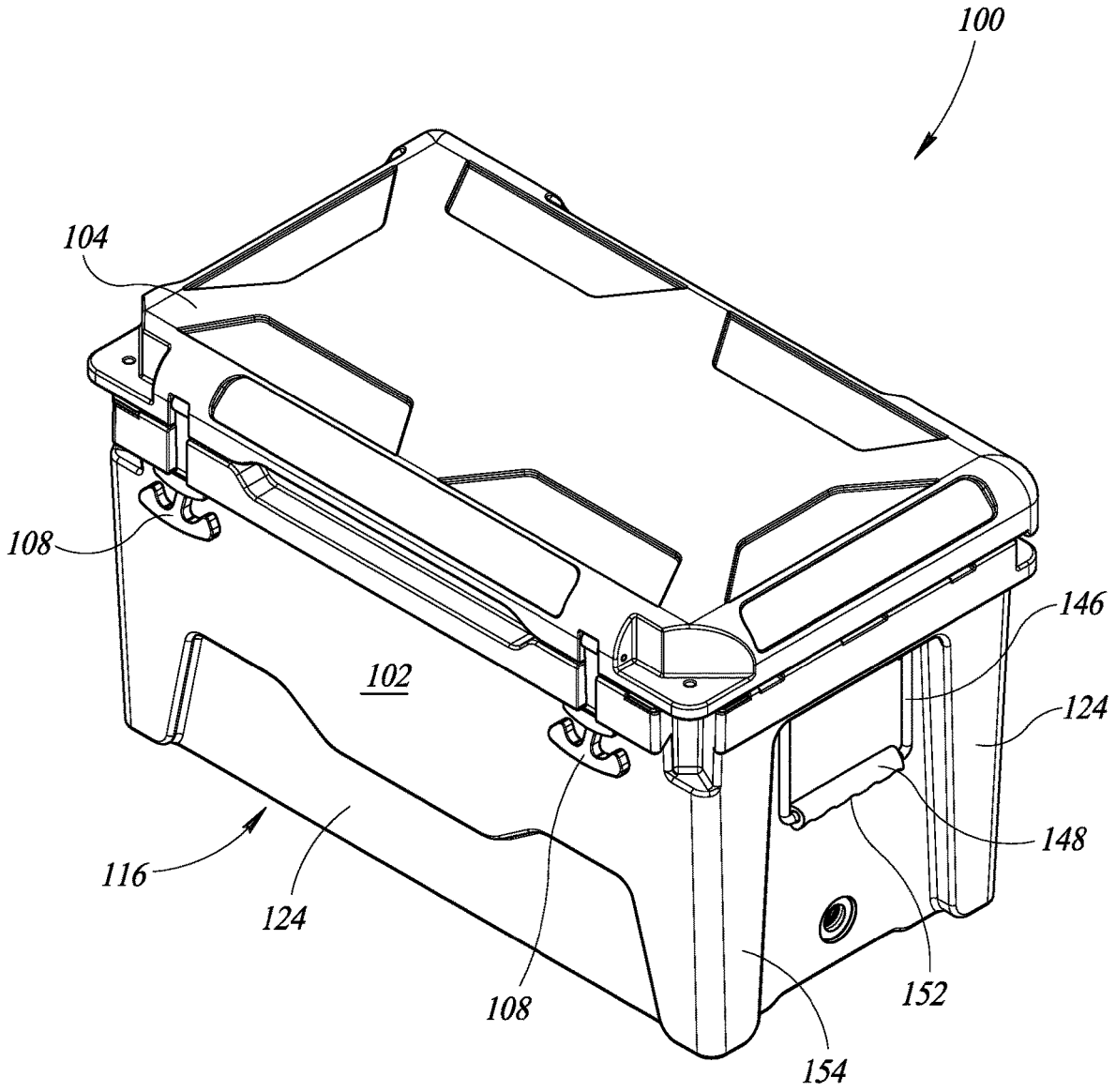
FIG. 1A is a perspective view of an exemplary embodiment of an insulating device according to the present disclosure having a lid secured to a chest of the insulating device by at least one latch, the lid illustrated in a closed position and the at least one latch illustrated in an engaged position.
Figure 1B:
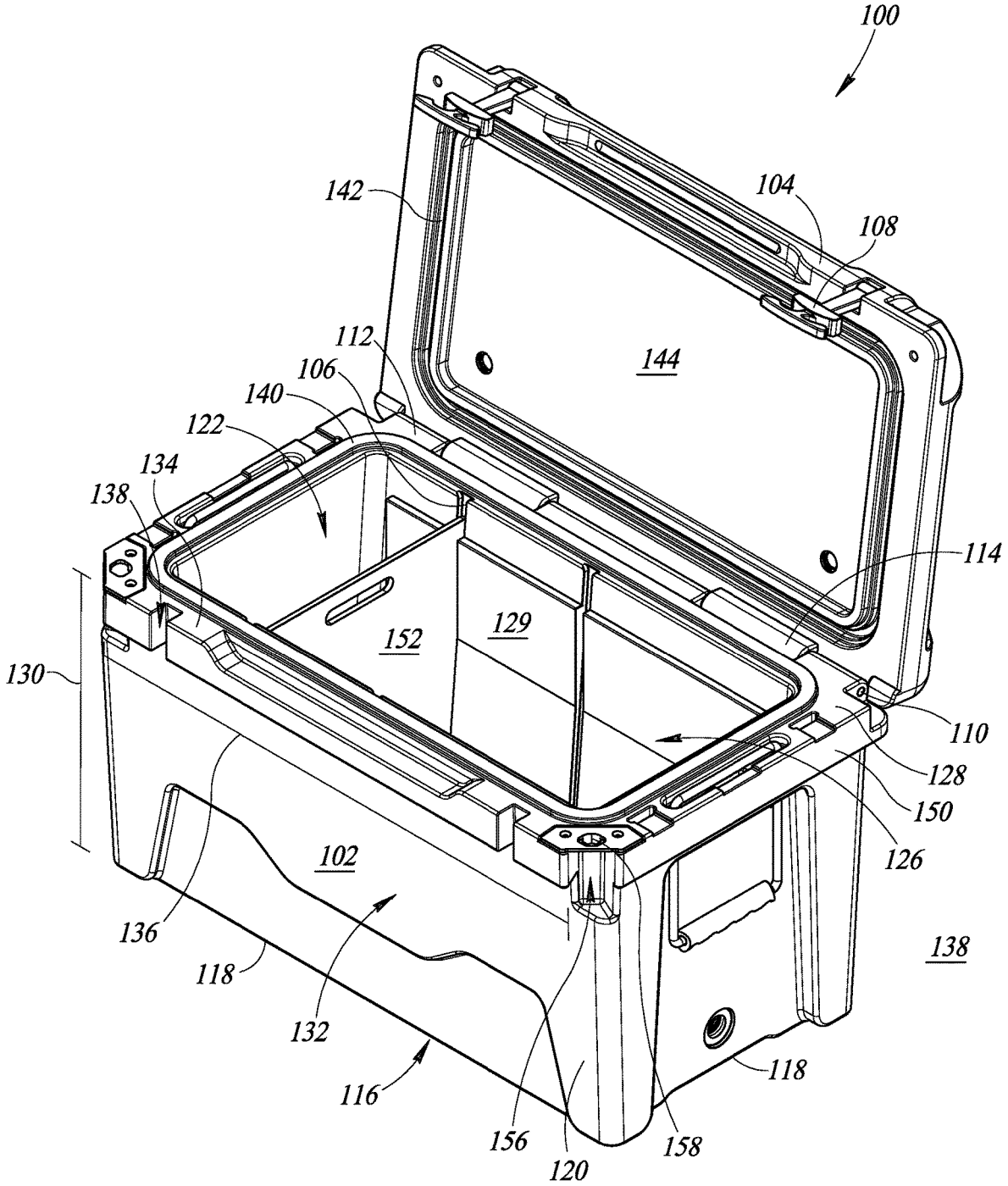
FIG. 1B is a perspective view of the insulating device of FIG. 1A, the lid illustrated in an open position and the at least one latch illustrated in a disengaged position.

FIG. 1A shows an insulating device 100 in the form of a cooler comprising a chest 102 coupled to a lid 104 with the lid 104 illustrated in a closed position and at least one latch 108 illustrated in an engaged position. FIG. 1B shows the insulating device 100 with the lid 104 illustrated in an open position and the at least one latch 108 illustrated in a disengaged position.

The insulating device 100 includes, for example, the chest 102 rotatably coupled to the lid 104 by a bolt (not shown) or other securing member inserted into hole 110 formed through a first lid support member 112 coupled to the chest 102 and a second lid support member 112 coupled to the lid 104. As such, a user can manipulate the lid 104 between the closed position illustrated in FIG. 1A and the open position illustrated in FIG. 1B.

The chest 102 further includes a bottom 116 having a periphery 118 and at least one peripheral wall 120 that extends from the bottom 116 along the periphery 118 to delineate an interior 122 of the chest 102. It is further recognized that in some instances, the at least one peripheral wall 120, and the insulating device 100 in general, have a generally rectangular shape, such that the at least one peripheral wall 120 comprises a plurality of sidewalls 124 of the chest 102. In addition, it is to be appreciated that the bottom 116 and the at least one peripheral wall 120 can be integrally formed together as a unitary piece, such that the chest 102 is a single unit. Exemplary processes for forming the chest 102 and the lid 104 include rotational molding, blow molding, or injection molding, among others. Exemplary materials for forming the insulating device 100 include polyethylene, linear low-density polyethylene (LLDPE), low-density polyethylene (LDPE), high density polyethylene (HDPE), cross-linked polymers or polyethylene, polyvinyl chloride (PVC), nylon, polypropylene, polycarbonate, thermoplastic polyester polymers, regrind, and PVC plastisols, or any combination thereof, among others. Further, it may be desirable to combine any of the above materials with certain additives, such as colorants, anti-static agents, cross-linking agents, flame retardants, flow modifiers, foaming agents, heat stabilizers, impact modifiers, or UV stabilizers, among others.

The chest 102 includes an opening 126 at a top 128 thereof. The chest 102 further includes a height 130 extending from the bottom 116 to the top 128 of the chest 102. In other words, the top 128 is opposed across the height 130 from the bottom 116 of the chest 102. The chest 102 further includes a front 132. A ledge 134 extends outwardly from the at least one peripheral wall 120 at the front 132. As shown more clearly in FIG. 1B, the ledge 134 extends across a width 136 of the front 132. The ledge 134 further includes at least one slot 138 that extends laterally through the ledge 134.

When the lid 104 is in the closed position, the lid 104 covers the opening 126 of the chest 102 to seal the interior 122 of the chest 102 from an exterior 138 thereof. In this embodiment, a seal is created between a ridge 140 extending from the top 128 of the chest 102 that is received by a similarly sized and shaped space 142 on a bottom 144 of the lid 104. In some cases, the ridge 140 and the space 142 in the lid 104 create a hermetic seal through a friction fit wherein the ridge 140 is formed of rubber that is received by the correspondingly sized and shape space 142. In other embodiments, the ridge 142 is integrally formed with the top 128 of the chest 102 and a gasket (not shown) is positioned in the space 142, such that when the gasket (not shown) engages the ridge 140, a watertight and airtight seal is created between the lid 104 and the chest 102, or between the interior 122 of the chest 102 and the exterior 138.

When the lid 104 is in the open position, at least a portion of the lid 104 is spaced from the opening 126 to provide access to the interior 122 of the chest 102 from the exterior 138 thereof. As such, it is to be appreciated the open position includes any number of positions of the lid 104 during rotation from the closed position to the position illustrated in FIG. 1B, which is a completely open position. In an embodiment, the insulating device 100 includes channels 106 formed in an interior surface 129 of the chest 102. The channels 106 have a size and a shape to receive a cutting board 152 for storage. In other words, the cutting board 152 and the channels 106 are dimensioned to allow the user to slide the board 152 in and out of the channels 106 for storage or for use.

To aid a user in carrying the device 100, a carrying handle 146 can be coupled to the chest 102 adjacent a portion 154 of the at least one peripheral wall 120. The carrying handle 146 preferably comprises rope, although other materials may be used. In addition, as illustrated in FIG. 1A, the carrying handle 146 may include a grasping member 148 having a plurality of inserts 152 having a size and a shape to receive one or more fingers of the user. Further, the grasping member 148 can comprise foam in order to provide additional comfort to the user while carrying the device 100, although other materials may also be useful, such as rubber. While only one carrying handle 146 is illustrated and it is possible to have an insulating device 100 with only one such handle 146, it is to be understood that a preferable embodiment includes a second handle (not shown) opposite the handle 146, such that the user can use both hands to carry the device 100.

The carrying handle 146 is coupled through a lip 150 extending from the at least one peripheral wall 120 adjacent the ledge 134. Such coupling is achieved by forming holes through the lip 150 and inserting the carrying handle 146 through the holes, such that when an upward tension force is applied by the user to the carrying handle 146, the carrying handle 146 will bend around, and contact, the lip 150. The illustrated embodiment in FIG. 1B further includes an external cavity 152 formed adjacent the ledge 134 and the lip 150 and a bottle opener 158 coupled to the ledge 134 and the lip 150 and overlying a portion of the external cavity 156. As such, a user can insert an upper portion of a bottle (not shown) containing a cap (not shown) into the external cavity 156 in order to create leverage against the bottle opener 158 to open the bottle (not shown).

FIGS. 1A and 1B also illustrate the at least one latch 108 in the engaged position and the disengaged position, respectively. The at least one latch 108 is movable between the engaged and disengaged positions by being elastically stretchable from a relaxed configuration to a tensioned configuration. In the engaged position illustrated in FIG. 1A, the at least one latch 108 is in the tensioned configuration wherein the latch is under tension from elastic deformation of the elastic material comprising the latch 108. In the disengaged position illustrated in FIG. 1B, the at least one latch 108 is in the relaxed configuration, or is not in tension. The at least one latch 108 is rotatably coupled to the lid 104 such that a user can manipulate the at least one latch 108 between the relaxed configuration and the tensioned configuration by applying a generally downward force to the elastic material comprising the at least one latch 108.

Figure 2:
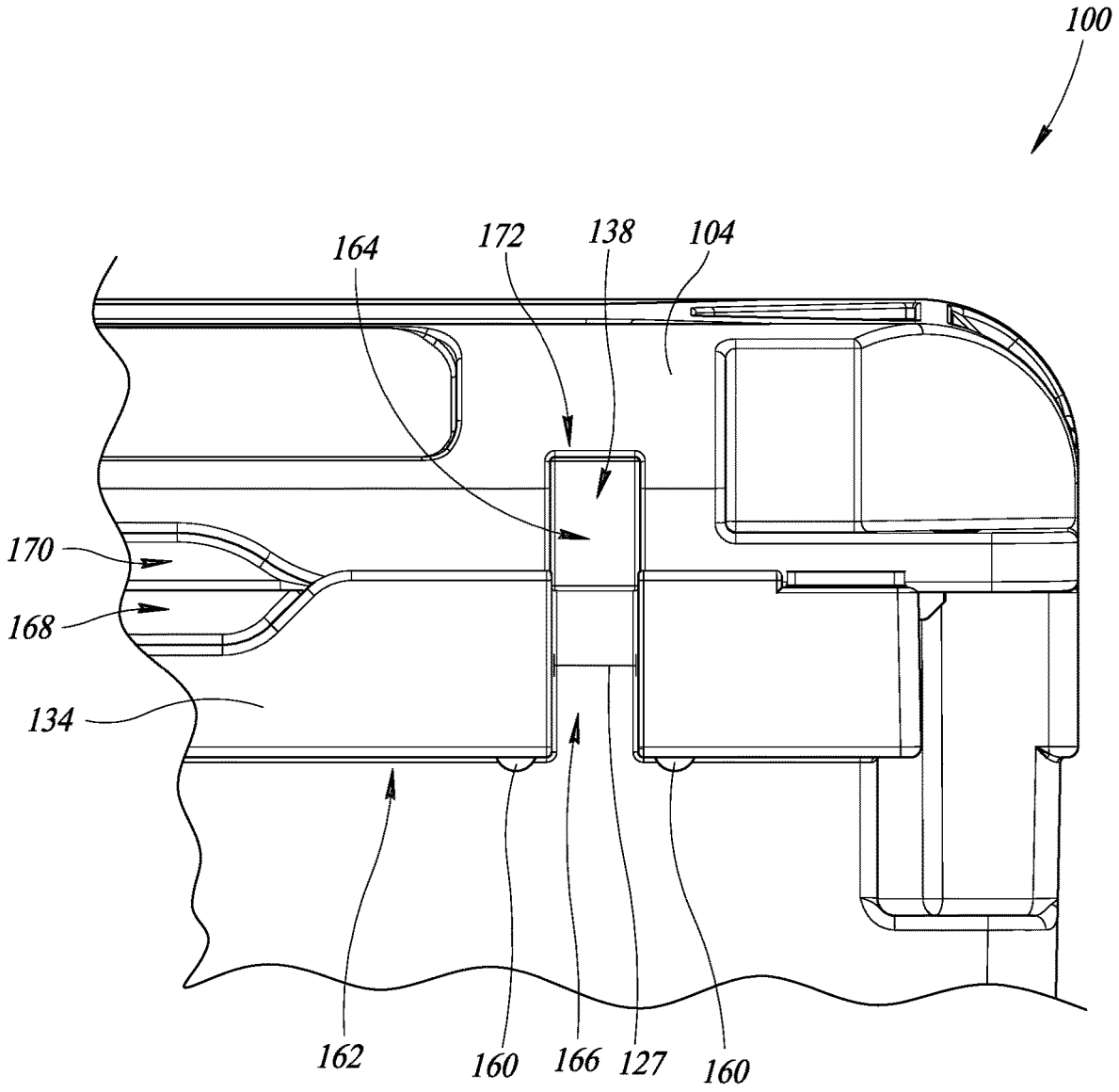
FIG. 2 is a partial front elevational view of the insulating device of FIG. 1A illustrating a pair of protrusions formed on a surface of a ledge extending from a peripheral wall of the chest.

FIG. 2 is a partial front elevational view of the insulating device 100 with a pair of protrusions 160 extending from the ledge 134. More particularly, the ledge 134 includes a first, or bottom, surface 162 with the protrusions 160 formed thereon and extending away from the first surface 162. Further, one of the protrusions 160 is spaced on either side of each of the at least one slot or slots 138. The slot 138 further consists of a first cavity 164 formed in the lid 104 and a second cavity 166 formed in the ledge 134. The first and second cavities 164, 166 align and cooperate to create the slot 138 when the lid 104 is in the closed position, as illustrated. In some instances, the slot 138 is sized and shaped to receive a body 184 (FIG. 4) of the at least one latch 108 in a friction fit, as described below. It is to be further appreciated that although the protrusions 160 are illustrated with a generally rounded, curved shape, that the protrusions 160 can be formed to have any number of different shapes, for example a cube, a rectangular prism, a cone, a trapezoid, and truncated or rounded variations of the same.

In an embodiment, the insulating device 100 further includes a first insert 168 formed in the ledge 134 opposite a second insert 170 formed in the lid 104. The first and second inserts 168, 170 allow a user to more conveniently manipulate the lid 104 to the open position, as the user can insert one or more fingers between the first and second inserts 168, 170 and lift the lid 104 from the closed position to the open position by applying a force against the second insert 170 of the lid 104 when the latch 108 is in the disengaged position.

Figure 3:
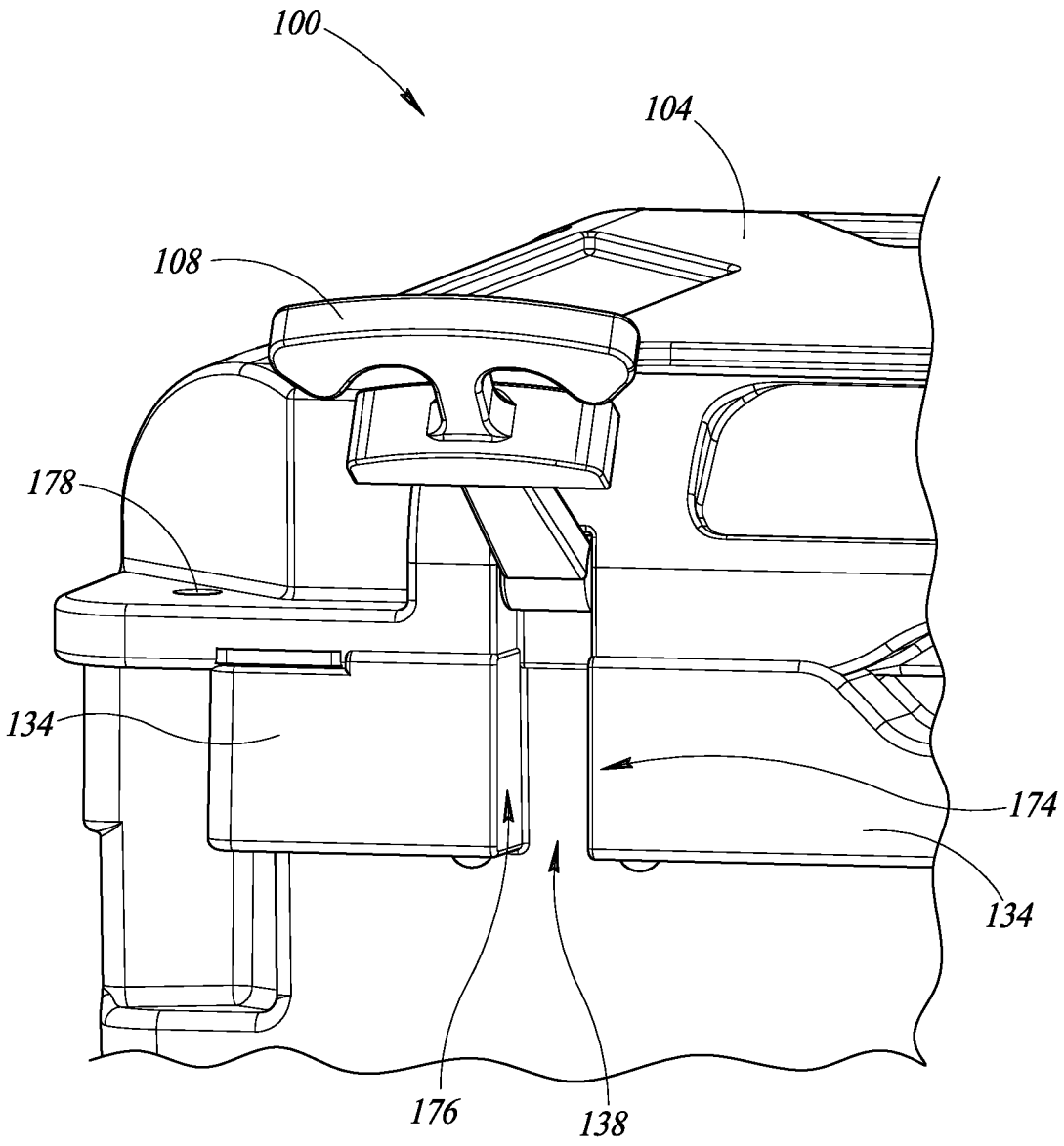
FIG. 3 is a partial view of the insulating device of FIG. 1A having a slot in the ledge, the lid illustrated in the closed position and the at least one latch illustrated in the disengaged position.

FIG. 3 illustrates the at least one slot 138 of the insulating device 100 in more detail. The at least one slot 138 is defined by a first surface 172 (FIG. 2) at a top portion thereof, and opposing second and third surfaces 174, 176. In the illustrated embodiment, each surface 172, 174, 176 is flat and planar. In other words, each surface 172, 174, 176 defining the at least one slot 138 is flat and planar. In addition, the lid 104 can include a hole 178 that aligns with the bottle opener 158 (FIG. 1B), such that when the lid 104 is in the closed position, the user can secure a lock (not shown) or other device through the hole 178 and the bottle opener 158 (FIG. 1B) in order to securely lock the lid 104 in the closed position. Such a locking arrangement is particular useful for "bear-proofing" the insulating device 100.

Figure 4:
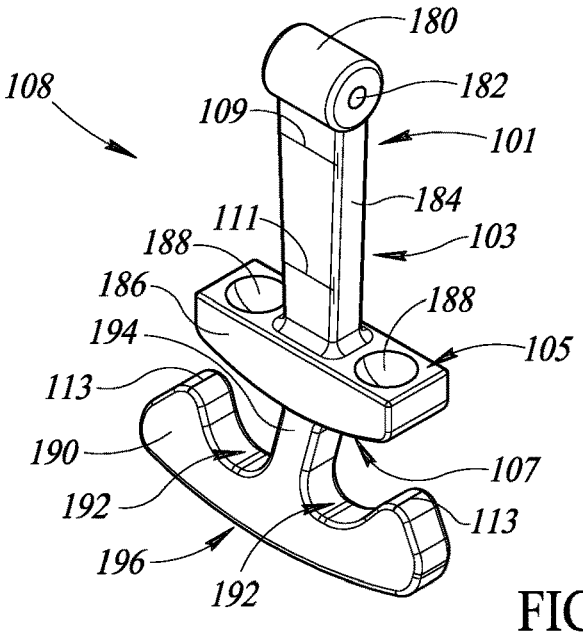
FIG. 4 is a perspective view of an exemplary embodiment of a latch of FIG. 1A having a latch handle and a pair of recesses.

FIG. 4 illustrates the at least one latch 108 in more detail. The at least one latch 108 includes a cylindrical base 180 with a central hole 182 therethrough to facilitate coupling the latch 108 to the lid 104 with a screw or bolt (not shown). The body 184 is coupled to the base 180 and extends from the base 180. The body 184 further includes a first portion 101 coupled adjacent the base 180 and a second portion 103 opposite the first portion 101. The body 184 has a generally tapered shape from the first portion 101 to the second portion 103, or in other words, a thickness 109 of the first portion 101 is greater than a thickness 111 of the second portion 103. In some instances, the taper is continuous along a length of the body 184. However, it is to be understood that other embodiments may include the body 184 with a uniform thickness, or a taper in the opposite direction (i.e. the thickness 111 of the second portion 103 being greater than the thickness 109 of the first portion 101). Further, the latch may be formed as a single, unitary, integral piece from any one of a number of elastic materials, such as rubber, or other elastomers through injection molding, blow molding, rotational molding, or other forming processes.

A receiving member 186 is coupled to the body 184 adjacent the second portion 103. The receiving member 186 has a first surface 105 opposite a second surface 107. In this embodiment, the first surface 105 is flat and planar, while the second surface 107 is curved, or non-linear. However, it is to be understood that the receiving member 186 and the surfaces 105, 107 may have any suitable shape or curvature. One or more recesses 188, which in this instance are a pair of recesses, are formed in the first surface 105 and spaced on either side of the body 184. The recesses 188 have a size and a shape to receive the protrusions 160 formed on the ledge 134. Further, it is to be appreciated that although the receiving member has a generally rectangular shape with three rectilinear edges and one curved edge defined by the second surface 107, the receiving member 186 can also take on other suitable shapes or geometries.

The at least one latch 108 further includes a handle 190 coupled to the second surface 107 of the receiving member 186 and extending away from the second surface 107. The handle 190 includes a base 194 coupled to the second surface 107 and a grasping portion 196. In the illustrated embodiment, a pair of opposing curved inserts 192 are formed in the grasping portion 196 on either side of the base 194. The inserts 192 are sized and shape to receive one or more fingers of a user, in order to more easily facilitate manipulating the latch between the relaxed and tensioned configurations described above with respect to FIGS. 1A-B. Each curved insert 192 is further defined by a ridge 113 extending from the grasping portion 196 on either side of the handle 190 toward the second surface 107. In certain other embodiments, the handle 190 is coupled to the receiving member 186 at a different location, for example, at a front or rear surface thereof, or at an edge between the front or rear surfaces and the second surface 107.

In an embodiment, the at least one latch 108 does not include the base 194, but rather, the ridges 113 extend to, and connect with, the second surface 107 of the receiving member 186. In such an arrangement, the grasping portion 196 and the handle 190 become a single, integral, unitary member with the receiving member 186, with the handle 190 and the grasping portion 196 having an annular, or semi-circular, shape with a central hole therethrough bounded by the second surface 107 of the receiving member 186 and the handle 190 and grasping portion 196. Ideally, the central hole is sized and shaped to receive one or more fingers of a user. It is to be further understood that although this single, unitary piece may have a handle 190 and grasping portion 196 with an annular, curved, or semi-circular shape, that other geometric, rectilinear, or curved shapes are possible for the handle 190 and grasping portion as well, such as a rectangular, trapezoidal, pentagonal, triangular, or ovular shape.

In an embodiment, the handle 190 and thus the grasping portion 196 are removed along with the base 194, and the receiving member has a size and a shape to be received by the hands or fingers of a user, such that the user can manipulate the at least one latch 108 without a handle 190. For example, the receiving member 186 may include dimples or slots in sidewalls of the receiving member 186, such that the user can grasp the receiving member 186 with two fingers to apply the necessary force to manipulate the latch 108 between the engaged and the disengaged positions.

It is to be further appreciated that although the recesses 188 are illustrated as extending only a certain distance, or depth, into the first surface 105 of the receiving member 186, that the embodiments of the present disclosure include the recesses 188 at a variety of depths, including a depth that extends all the way through the receiving member 186 to form a hole through the receiving member 186 with a diameter equivalent to that of the recesses 188. In other embodiments, the diameter of the recesses 188, or hole, may be tapered along a depth of the recess 188 in order to securely physically receive and engage a protrusion 160 with a tapered or truncated shape.

Figure 5:
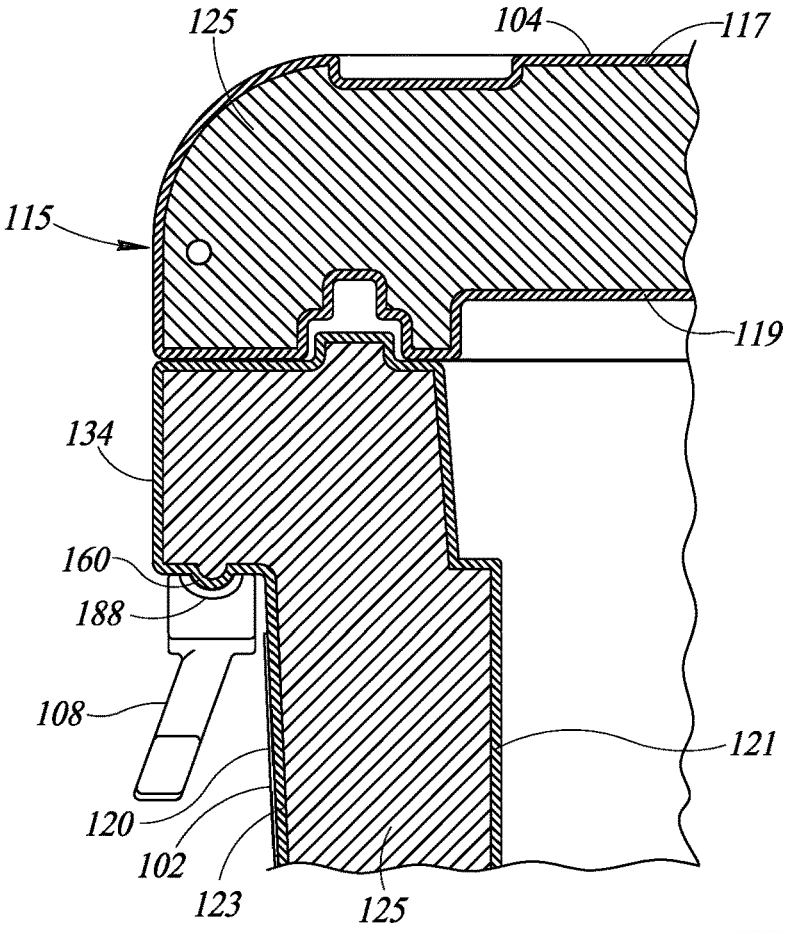
FIG. 5 is a partial cross-sectional view of the insulating device of FIG. 1A, the protrusions on the surface of the ledge engaged with the recesses in the latch.

FIG. 5 illustrates the lid 104 in the closed position and the at least one latch 108 in the engaged position. In the engaged position, the at least one latch 108 securely couples a front portion 115 of the lid 104 in the closed position to the chest 102. When the at least one latch 108 is in the engaged position, the protrusions 160 extending from the ledge 134 are physically securely engaged with the recesses 188 on the at least one latch 108.

The protrusions 160 are securely engaged in the recesses 188 not only because they are sized and shaped to be received by the recesses 188, but also because in the engaged position, the latch 108 is under tension due to elastic deformation of the latch 108, as described herein. To release the latch 108 from the engaged position, the user exerts a generally downward tension force on the latch 108 while rotating the latch 108 away from the peripheral wall 120 until the protrusions 160 are unseated from the recesses 108. Then, the latch 108 can be released to the disengaged position and the lid 104, and more particularly, the front portion 115 of the lid 104, is released from the chest 104, such that the lid 104 can be moved to the open position.

FIG. 5 further illustrates that the peripheral wall 120 of the chest 102 can include an interior wall 121 spaced from an exterior wall 123 to form a first shell. In an embodiment, the first shell is filled with insulation 125. In other words, insulation 125 is formed in the space between the interior and exterior walls 121, 123 and in contact with the walls 121, 123. Similarly, the lid 104 includes a top wall 117 spaced from a bottom wall 119 to form a second shell, wherein insulation 125 is formed in the space between the top and bottom walls 117, 119 and in contact with the walls 117, 119. It is to be further appreciated that the walls 117, 119, 121, 123 may be formed with varying thicknesses, and while the walls 117, 119, 121, 123 are illustrated as one layer of material, in an embodiment, the walls 117, 119, 121, 123 may include several layers of material, wherein each layer includes the same or a different composition of the materials noted above for forming the insulating device 100.

Hence, in operation, and with reference to FIGS. 1A-5, the latch is secured to the first cavity 164 of the lid 104 through the central bore 182 and a user can move the latch 108 between the engaged position and the disengaged position. In the disengaged position, the body 184 of the latch 108 is not secured by the slot 138, the recesses 188 are not engaged with the protrusions 160, and no force is exerted on the latch. As such, the latch 108 is coupled to the lid 104, but experiences no deformation and is free to rotate, such that the user can rotate the lid 104 to the open position for accessing the interior 122 of the insulating device 100.

When a user wishes to secure the lid 104 in the closed position, the user exerts a downward force on the lid 104 such that the lid rotates to come into contact with the base 102. Then, the user rotates the at least one latch 108 about the central bore 182 and toward the bottom 116 of the chest 102 and exerts a generally downward axial tension force on the handle 190 of the at least one latch 108 to stretch the latch 108 into the tension configuration. This tension force causes the stretchable material that comprises the latch 108 to deform in the sense that a length of the latch 108 is extended in the axial direction of the force, while a width or thickness 109, 111 of the body 184 of the latch 108 is narrowed in a corresponding fashion.

Because the at least one slot 138 preferably has a width 127 that is less than a thickness 109, 111 of the body 184 of the latch 108 in the relaxed configuration, but greater than a width of the stretched body in the tensioned configuration, when the latch 108 is stretched to the tensioned configuration, the narrowed width of the body 184 can be received by the slot 138. Further, a length of the latch 108 in the relaxed configuration is preferably less than a length required for the receiving member 186 of the latch 108 to clear the protrusions 160. In other words, in the relaxed configuration, the receiving member 186 can contact the protrusions 160, but it is not possible to seat the protrusions 160 in the recesses 188 in the receiving member 186. However, when the user exerts the downward axial tension force on the latch 108, thereby extending the length of the latch 108, the length of the latch 108 in the stretched, tensioned configuration allows the user to extend the receiving member 186 beyond the protrusions 160 and align the protrusions 160 in the recesses 188.

Once the protrusions 160 and recesses 188 are aligned and the body 184 of the latch 108 is secured in the slot 138, the user releases the tension force to place the latch 108 in the engaged position. In this position, the latch 108 is held in tension (i.e. the length of the latch 108 when the protrusions 160 are engaged with the recesses 188 is greater than the length of the latch 108 in the relaxed, disengaged configuration) with the body 184 of the latch 108 received in the slot 138 by a friction fit and the protrusions 160 secured in the recesses 188. As such, a downward tension force equal to, or greater than, the force applied while the user holds the latch 108 in the stretched, tensioned configuration must be exerted on the latch 108 before an angular rotation force can be applied to remove the latch 108 from the engaged position. In this manner, the slot 138 coordinates with the body 184 of the latch 108 and the protrusions 160 coordinate with the recesses 188 to secure the latch 108 in the engaged position, thereby securing the lid 104 in the closed position.

FIG. 6 illustrates an alternative exemplary embodiment of an insulating device 200 in the form of a cooler formed in accordance with the present disclose including a latch 202 coupled to a lid 214 with the latch having one or more protrusions 204, or in this case, a pair of protrusions, extending away from a first surface 218 of the latch 202, the first surface 218 being opposite a second surface 220. The protrusions 204 are received by recesses 206 formed in a bottom surface 208 of a ledge 209 that extends from at least one peripheral wall 210 of a chest 212. In this manner, the latch 202 holds a front portion 216 of the lid 214 in the closed position. The remaining features of the insulating device 200 are omitted for brevity and clarity, although it is to be understood that the insulating device 200 can include any or all of the features described above with reference to the embodiments of the insulating device 100 in FIGS. 1A-5.

Although certain embodiments of the present disclosure described herein are illustrated with the pair of protrusions 160 on either side of each slot 138 that correspond to the pair of recesses 188 on the latch 108, certain other embodiments include the ledge 134 with the slot 138 and for each slot 138, a single protrusion 160 extending from the ledge on one side, and a single recess 188 in the ledge 134 on the opposite side of the slot 138. Similarly, the latch 108 includes a single recess 188 in the latch 108 that corresponds to the protrusion 160 on the ledge 134 and a single protrusion 160 on the latch 108 corresponding to the recess 188 in the ledge 134. In other words, the present disclosure includes alternating the protrusions 160 and recesses 188. In certain other embodiments, the ledge 134 includes only one protrusion 160 or one recess 188 and the latch 108 includes a corresponding singular recess 188 or protrusion 160. As such, any number of different arrangements are available for the latch 108, the protrusions 160, and the recesses 188, such that a single recess 188 and protrusion 160 may be used, or two, three, four, or more protrusions 160 and recesses 188 may be used, each with different characteristics than the other protrusions 160 and recesses 188.

Figure 6A:
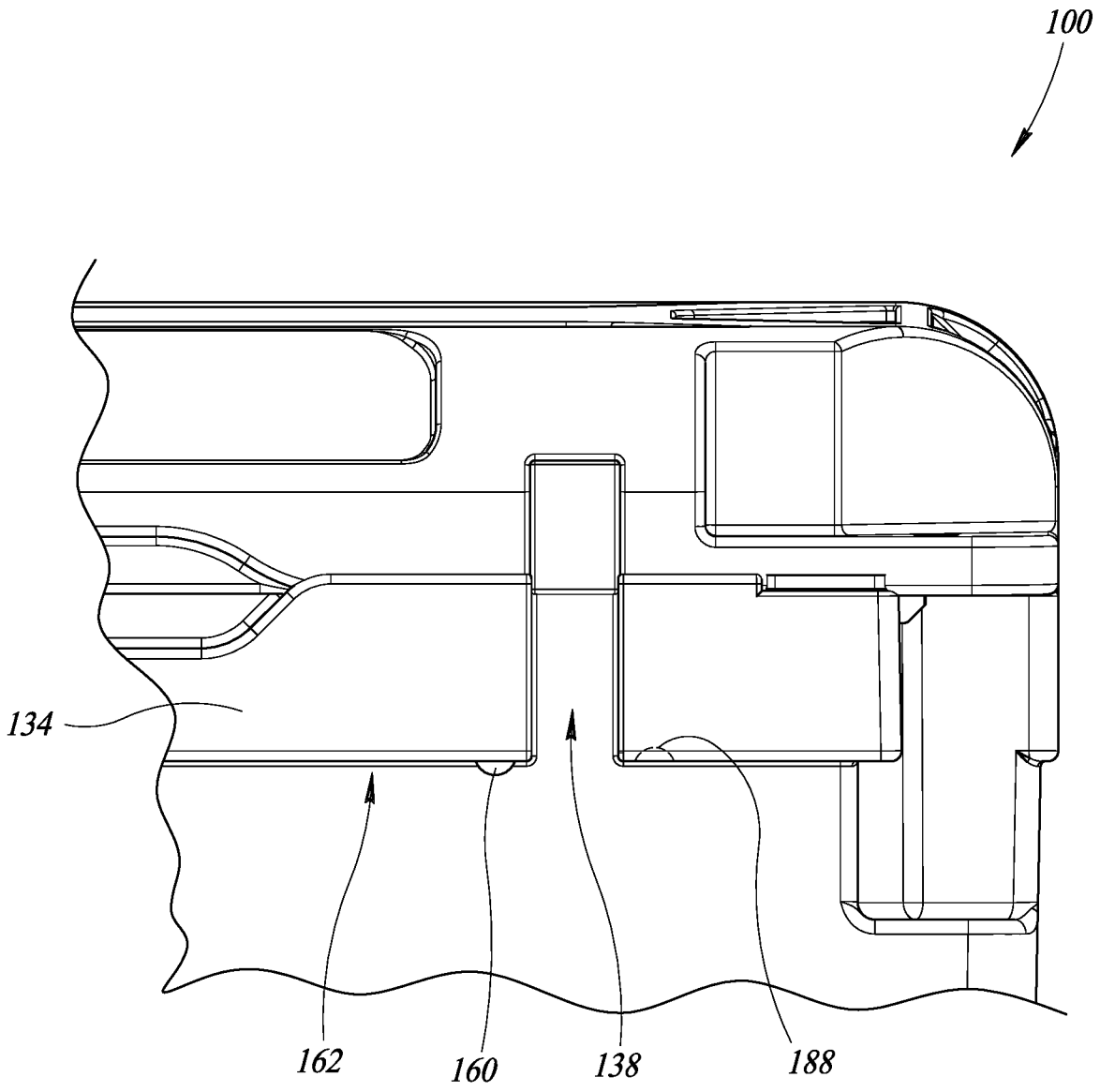
FIGS. 6A and 6B are views of an alternative exemplary embodiment of the insulating device of FIG. 1A illustrating the ledge having at least one protrusion and at least one recess and the latch having a corresponding at least one recess and at least one protrusion.
Figure 6B:
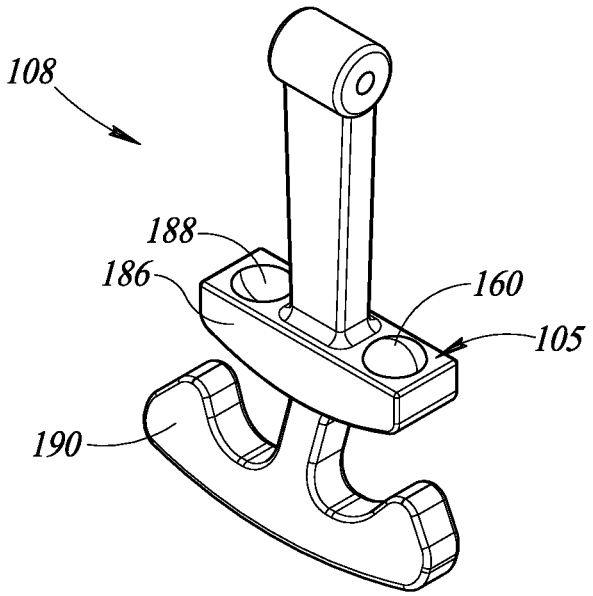
Figure 7:
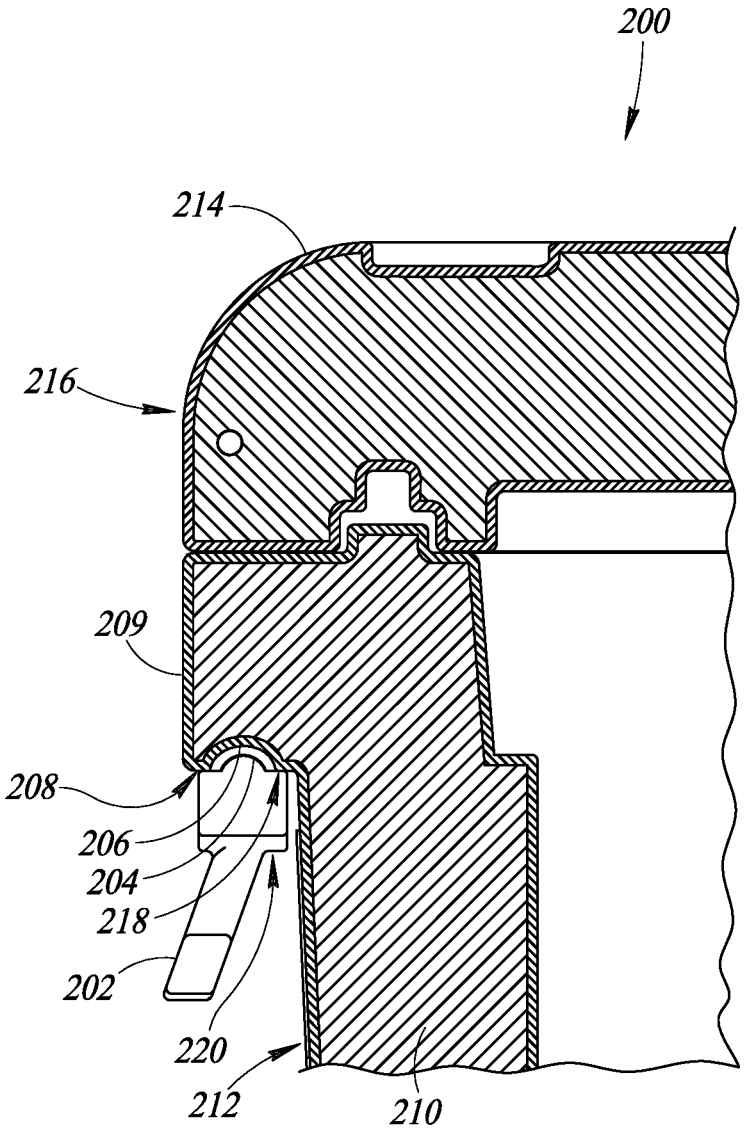
FIG. 7 is a partial cross-sectional view of an alternative exemplary embodiment of an insulating device according to the present disclosure showing a latch with a protrusion and a ledge extending from a chest with a recess, the protrusion engaged in the recess.

For example, in the embodiment illustrated in FIGS. 6A and 6B, the insulating device 100 includes the ledge 134 with at least one protrusion 160 extending from the first surface 162 of the ledge 134. The ledge 134 further includes at least one recess 188 in the first surface 162. The at least one protrusion 160 and the least one recess 188 are spaced on either side of the slot 138. In other embodiments, the at least one protrusion 160 and the at least one recess 188 in the ledge 134 may be reversed, as described above. The latch 108 includes the receiving member 186 and the handle 190, with the receiving member including the first surface 105. At least one recess 188 is formed in the first surface 105 of the receiving member 186 with a size and a shape that corresponds to a size and shape of the at least one protrusion 160 on the ledge 134. The receiving member 186 further includes at least one protrusion 160 extending from the first surface 105 that has a size and a shape to correspond to a size and a shape of the at least one recess 188 in the ledge 134.

Accordingly, embodiments of the present disclosure include alternating, or opposite, series of recesses and protrusions 188, 160 formed in the ledge 134 that correspond to alternating protrusions and recesses 160, 188 formed in the latch 108. As noted above, one of skill in the art will further appreciate that only one protrusion 160 extending from the ledge 134 may be received by only one recess 188 in the latch, and vice versa, in order to physically secure the lid 104 to the chest 102 with the latch 108.

Even though the illustrations accompanying the present disclosure show an insulating device 100 with two latches 108, one of skill in the art will appreciate that the lid 104 can be secured to the chest 102 with only one latch 108 formed in accordance with the present disclosure and received by the ledge 134 or chest 102 anywhere along the width 136 of the chest 136. Ideally, if one latch 108 is used, the latch 108 will be received by a centrally located slot 138, in order to securely fasten the lid 104 to the chest 102. Further, one of skill in the art will understand that although the illustrated embodiments show the latches 108 received by slots 138 in the ledge 134 at the front of the chest 102, the latches 108 can be received by a slot, or slots, 138 in a ledge 134 formed at the sides of the chest 102, or at the rear of the chest 102.

It is also to be understood that although the insulating device 100 is illustrated with the latches 108 being manipulated in a generally downward direction to engage the protrusions 160, which extend in a downward direction from the ledge 134, that the embodiments of the present disclosure include the inverse as well. For example, in certain embodiments, the latch 108 is coupled to the second cavity 166 in the ledge 134 of the chest 102. Then, the first cavity 164 is extended through the lid 104, with protrusions 160 extending from the lid 104 on either side of the slot 134 to engage recesses 188 in the latch 108, as described herein.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art. The teachings provided herein of the various embodiments can be applied to other devices that form a seal or that require a first member to be securely attached to a second member, such as a window, a refrigerator or freezer, a gate, a door, a bag or other carrying container, and a storage container, among others, and not necessarily the exemplary insulating device and latch generally described above. Further, although the components and features of the insulating device described herein are discussed as separate pieces, one of skill in the art will appreciate that modern forming processes, including blow molding and rotational molding, allow for pieces to be integrally formed. In particular, the chest, the lid, and the latch may each be formed as singular integral units or as separate components that are coupled together by conventional methods and devices.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An insulating container system, comprising:

a chest, the chest including a bottom having a periphery and at least one peripheral wall that extends from the bottom along the periphery to delineate an interior of the chest, the chest having an opening at a top thereof, the top opposed across a height of the chest from the bottom of the chest, the chest having a front with a ledge that extends outwardly from the at least one peripheral wall at the front, the ledge having at least one slot that extends laterally through the ledge, wherein for each of the at least one slot, at least one protrusion spaced from the respective slot;

a lid coupled to the chest for movement between a closed position and an open position, in the closed position the lid covering the opening of the chest to seal the interior of the chest from an exterior thereof and in the open position at least a portion of the lid spaced from the opening to provide access to the interior of the chest from the exterior thereof; and at least one latch, the at least one latch being elastically stretchable from a relaxed configuration to a tensioned configuration, the latch having a handle and at least one recess, the at least one latch movable between an engaged position where the at least one latch is in the tensioned configuration and a disengaged position in which the at least one latch is in the relaxed configuration, in the engaged position the at least one latch securely coupling under tension a front portion of the lid in the closed position to the chest, and in the disengaged position releasing the front portion of the lid from the chest to allow the lid to move to the open position, the at least one recess sized to physically securely engage complimentary ones of the at least one protrusion when the latch is in the engaged position and under tension from elastic deformation when in the tensioned configuration.

2. The insulating container system of claim 1 wherein when the lid is in the closed position, the seal between the interior of the chest and the exterior thereof is a hermetic seal.

3. The insulating container system of claim 1 wherein the at least one slot is sized to engage a portion of the latch in the engaged position in a friction fit.

4. The insulating container system of claim 1 wherein the at least one protrusion includes a pair of protrusions spaced on either side of the respective slot and the at least one recess includes a pair of recesses sized to physically securely engage complimentary ones of the pair of protrusions when the latch is in the engaged position and under tension from elastic deformation when in the tensioned configuration.

5. The insulating container system of claim 1 wherein the chest further includes an external cavity adjacent the ledge and a bottle opener coupled to the chest and overlying a portion of the external cavity.

6. The insulating container system of claim 1 wherein each surface defining the at least one slot is flat and planar.

7. The insulating container system of claim 1 wherein the handle of the latch includes a pair of opposing curved inserts each defined by a ridge, the pair of opposing curved inserts sized to receive one or more fingers of a user.

8. An insulating container system, comprising:

a chest, the chest including a bottom having a peripheral edge and at least one peripheral wall that extends from the bottom along the peripheral edge to delineate an interior of the chest, the chest having an opening at a top thereof, the top opposed across a height of the chest from the bottom of the chest, the at least one peripheral wall having a front with a ledge that extends outwardly from the front, the ledge having at least one slot, wherein for each of the at least one slot, at least one recess spaced from the respective slot;

a lid coupled to the chest for movement between a closed position and an open position, in the closed position the lid covering the opening of the chest to seal the interior of the chest from an exterior thereof and in the open position at least a portion of the lid spaced from the opening to provide access to the interior of the chest from the exterior thereof; and at least one latch, the at least one latch being elastically stretchable from a relaxed configuration to a tensioned configuration and movable between an engaged position and a disengaged position, the at least one latch having a handle and at least one protrusion, in the engaged position the at least one latch being in the tensioned configuration and securely coupling a front portion of the lid in the closed position to the chest, and in the disengaged position releasing the front portion of the lid from the chest to allow the lid to move to the open position, the at least one recess sized to physically securely engage complimentary ones of the at least one protrusion when the latch is in the engaged position and under tension from elastic deformation in the tensioned configuration.

9. The insulating container system of claim 8 wherein when the lid is in the closed position, the seal between the interior of the chest and the exterior thereof is a hermetic seal.

10. The insulating container system of claim 8 wherein the at least one the ledge further includes at least one protrusion and the latch further includes at least one recess, the least one protrusion of the ledge sized to physically secure engage complimentary ones of the at least one recess when the latch is in the engaged position and under tension from elastic deformation in the tensioned configuration.

11. The insulating container system of claim 8 wherein the at least one peripheral wall is a shell with an exterior wall and an interior wall, the exterior wall spaced from the interior wall.

12. The insulating container system of claim 11 wherein the space between the exterior wall and the interior wall is filled with insulation.

13. The insulating container system of claim 8 wherein the bottom and the at least one peripheral wall are integrally formed as a unitary member.

14. The insulating container system of claim 8 wherein the latch further includes a body, a thickness of the body being continuously tapered along its length.

15. The insulating container system of claim 8 wherein the lid includes a cavity aligned with the at least one slot of the ledge when the lid is in the closed position, the latch coupled to the lid in the cavity.

16. A latch, comprising:

a cylindrical base having a central hole therethrough;

a body coupled to the base and having a first portion adjacent the base and a second portion;

a receiving member coupled to the body adjacent the second portion, the receiving member having a first surface opposite a second surface, the receiving member including one or more recesses formed in the first surface and spaced from the body;

a handle coupled to the second surface of the receiving member and extending from the second surface; and wherein the latch is elastically stretchable between a relaxed position and a tensioned position, in the tensioned position the latch being under tension from elastic deformation.

17. The latch of claim 16 wherein the first surface is flat and planar and the second surface is a curved surface.

18. The latch of claim 16 wherein a thickness of the first portion is greater than a thickness of the second portion.

19. The latch of claim 16 wherein the handle further includes a pair of opposing curved inserts, the pair of opposing curved inserts sized to receive one or more fingers of a user.

20. The latch of claim 19 wherein each curved insert is defined by a ridge extending toward the second surface.

* * * * *